US009761108B2

(12) United States Patent
Beaurepaire

(10) Patent No.: US 9,761,108 B2
(45) Date of Patent: Sep. 12, 2017

(54) APPARATUS, METHOD AND COMPUTER PROGRAM FOR MONITORING POSITIONS OF OBJECTS

(71) Applicant: HERE Global B.V., Eindhoven (NL)

(72) Inventor: Jerome Beaurepaire, Veldhoven (NL)

(73) Assignee: HERE Global B.V., Eindhoven (NL)

( * ) Notice: Subject to any disclaimer, the term of this patent is extended or adjusted under 35 U.S.C. 154(b) by 0 days.

(21) Appl. No.: 14/956,740

(22) Filed: Dec. 2, 2015

(65) Prior Publication Data

US 2016/0189516 A1 Jun. 30, 2016

(30) Foreign Application Priority Data

Dec. 2, 2014 (GB) ..... 1421400.1

(51) Int. Cl.

| | |
|---|---|
| ***G08B 21/02*** | (2006.01) |
| ***A45C 13/18*** | (2006.01) |
| ***G08B 5/22*** | (2006.01) |
| ***G08B 21/24*** | (2006.01) |

(52) U.S. Cl.

CPC ..... *G08B 21/0263* (2013.01); *A45C 13/18* (2013.01); *G08B 5/22* (2013.01); *G08B 21/0233* (2013.01); *G08B 21/0275* (2013.01); *G08B 21/0277* (2013.01); *G08B 21/0294* (2013.01); *G08B 21/24* (2013.01)

(58) Field of Classification Search

CPC ..... G08B 21/0263; G08B 21/0275; G08B 21/0294; G08B 21/22; G08B 21/24; G08B 21/0233; G08B 21/0277; A45C 13/18

USPC ..... 340/539.13

See application file for complete search history.

(56) References Cited

U.S. PATENT DOCUMENTS

| | | | | |
|---|---|---|---|---|
| 7,271,736 | B2 | 9/2007 | Siegel et al. | |
| 2003/0025597 | A1 | 2/2003 | Schofield | |
| 2005/0116821 | A1 | 6/2005 | Wilsey et al. | |
| 2008/0062120 | A1 * | 3/2008 | Wheeler | G08B 25/016 345/156 |
| 2008/0074262 | A1 | 3/2008 | Paulkovich | |

(Continued)

FOREIGN PATENT DOCUMENTS

| | | |
|---|---|---|
| GB | 2405512 | 3/2005 |
| WO | WO 2013/052863 | 4/2013 |

OTHER PUBLICATIONS

*Alert Parent: Cybertooth #328 at Invention Connection Online Cybershow* [online] [retrieved Oct. 21, 2014]. Retrieved from the Internet: <URL: http://www.inventionconnection.com/BOOTHS/booth328.html>. 3 pages.

(Continued)

*Primary Examiner* — Leon Flores

(74) *Attorney, Agent, or Firm* — Alston & Bird LLP

(57) ABSTRACT

An apparatus, method and computer program, the apparatus comprising: processing circuitry; and memory circuitry including computer program code; the memory circuitry and the computer program code configured to, with the processing circuitry, cause the apparatus to, at least in part: obtain information relating to a position of an object relative to a user; determine a field of vision of the user; determine whether or not the object is in the field of vision of the user; and if it is determined that the object is not in the field of vision of the user enable an alert to be provided.

21 Claims, 6 Drawing Sheets

(56) References Cited

U.S. PATENT DOCUMENTS

| | | | | |
|---|---|---|---|---|
| 2009/0201149 | A1 | 8/2009 | Kaji | |
| 2009/0243880 | A1 | 10/2009 | Kiuchi | |
| 2013/0141567 | A1 | 6/2013 | Walker et al. | |
| 2014/0002629 | A1 | 1/2014 | Ratcliff et al. | |
| 2014/0206389 | A1 | 7/2014 | Aldana et al. | |
| 2015/0146004 | A1* | 5/2015 | Kritt | G06K 9/00671 348/159 |
| 2016/0093105 | A1* | 3/2016 | Rimon | G06T 19/006 345/633 |

OTHER PUBLICATIONS

Search Report for corresponding Great Britain Application No. GB1421400.1 dated Apr. 25, 2015, 2 pages.

* cited by examiner

APPARATUS, METHOD AND COMPUTER PROGRAM FOR MONITORING POSITIONS OF OBJECTS

CROSS-REFERENCE TO RELATED APPLICATION

This application claims priority to and the benefit of United Kingdom Application No. 1421400.1, filed Dec. 2, 2014, the entire contents of which are hereby incorporated by reference.

TECHNOLOGICAL FIELD

Examples of the disclosure relate to an apparatus, method and computer program for monitoring positions of objects. In particular, they relate to an apparatus, method and computer program for ensuring objects remain within a user's field of view.

BACKGROUND

People often have to take care of other people and/or objects. For instance parents need to know where children in their care are so that they can ensure that they are safe. Similarly owners of valuable objects do not want to leave them unattended, for instance, a traveler with luggage at an airport must not leave the luggage unattended.

It is useful to provide an apparatus to help people keep their children and valuable objects safe.

BRIEF SUMMARY

According to various, but not necessarily all, examples of the disclosure there may be provided an apparatus comprising: processing circuitry; and memory circuitry including computer program code; the memory circuitry and the computer program code configured to, with the processing circuitry, cause the apparatus to, at least in part: obtain information relating to a position of an object relative to a user; determine a field of vision of the user; determine whether or not the object is in the field of vision of the user; and if it is determined that the object is not in the field of vision of the user enable an alert to be provided.

In some examples the apparatus may be further configured to monitor a trajectory of the object relative to the user and provide a warning alert if it is determined that the object is predicted to go out of the field of vision of the user.

In some examples the apparatus may be further configured to associate the object with a further object and predict movement of the object based on the movement of the further object.

In some examples determination of the field of vision of a user may comprise identifying one or more objects which obstruct the field of vision of the user. Three dimensional model information of a location of a user may be used to identify the one or more objects which obstruct the field of vision of the user.

In some examples determination of the field of vision of the user may comprise determination of at least one of; a direction the user is looking, a direction the user is travelling, a location of a user, items positioned between the user and the object.

In some examples the alert may be provided to the user.

In some examples the alert may be provided to the object.

In some examples the object may be a child.

In some examples the object may comprise an inanimate object.

In some examples the apparatus may be further configured to enable communication between a plurality of user devices and determine the field of vision of the plurality of users associated with the devices and enable an alert to be provided if the object moves out of the field of vision of the plurality of users.

According to various, but not necessarily all, examples of the disclosure there may be provided a communication device comprising an apparatus as described above.

According to various, but not necessarily all, examples of the disclosure there may be provided an electronic device for attachment to an object comprising an apparatus as described above.

According to various, but not necessarily all, examples of the disclosure there may be provided a method comprising: determining to obtain information relating to a position of an object relative to a user; determining a field of vision of the user; determining whether or not the object is in the field of vision of the user; and if it is determined that the object is not in the field of vision of the user enabling an alert to be provided.

In some examples the method may further comprise monitoring a trajectory of the object relative to the user and provide a warning alert if it is determined that the object is predicted to go out of the field of vision of the user.

In some examples the method may further comprise associating the object with a further object and predicting movement of the object based on the movement of the further object.

In some examples determining the field of vision of a user may comprise identifying one or more objects which obstruct the field of vision of the user. Three dimensional model information of a location of a user may be used to identify the one or more objects which obstruct the field of vision of the user, items positioned between the user and the object.

In some examples determining the field of vision of the user may comprise determining at least one of; a direction the user is looking, a direction the user is travelling, a location of a user.

In some examples the alert may be provided to the user.

In some examples the alert may be provided to the object.

In some examples the object may be a child.

In some examples the object may comprise an inanimate object.

In some examples the method may further comprise enabling communication between a plurality of user devices and determining the field of vision of the plurality of users associated with the devices and enabling an alert to be provided if the object moves out of the field of vision of the plurality of users.

According to various, but not necessarily all, examples of the disclosure there may be provided a computer program comprising computer program instructions that, when executed by processing circuitry, enable: determining to obtain information relating to a position of an object relative to a user; determining a field of vision of the user; determining whether or not the object is in the field of vision of the user; and if it is determined that the object is not in the field of vision of the user enabling an alert to be provided.

According to various, but not necessarily all, examples of the disclosure there may be provided a computer program comprising program instructions for causing a computer to perform the methods described above.

According to various, but not necessarily all, examples of the disclosure there may be provided a physical entity embodying the computer program as described above.

According to various, but not necessarily all, examples of the disclosure there may be provided an electromagnetic carrier signal carrying the computer program as described above.

According to various, but not necessarily all, examples of the disclosure there may be provided examples as claimed in the appended claims.

BRIEF DESCRIPTION

For a better understanding of various examples that are useful for understanding the detailed description, reference will now be made by way of example only to the accompanying drawings in which.

DETAILED DESCRIPTION

Figure 1:
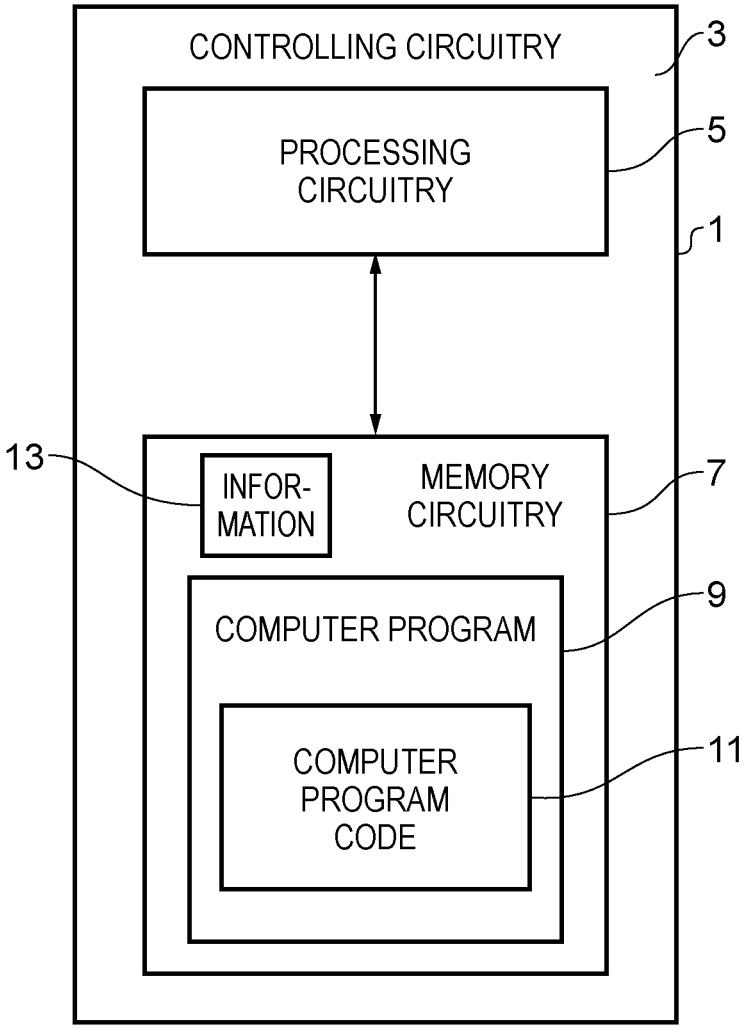
FIG. 1 illustrates an apparatus.

According to examples of the disclosure there may be provided an apparatus 1 comprising: processing circuitry 5; and memory circuitry 7 including computer program code 11; the memory circuitry 7 and the computer program code 11 configured to, with the processing circuitry 5, cause the apparatus 1 to, at least in part: obtain information relating to a position of an object relative to a user 27; determine a field of vision of the user 27; determine whether or not the object is in the field of vision of the user 27; and if it is determined that the object is not in the field of vision of the user 27 enabling an alert to be provided.

The apparatus 1 may be configured for wireless communication. The apparatus 1 may be for monitoring the position of an object such as child or a valuable inanimate object.

Examples of the disclosure provide a system for enabling users to keep track of objects such as a child or a valuable inanimate object by ensuring that the object remains in the field of view of the user. In some examples the system may be configured to provide an alert before the object moves out of the field of view.

FIG. 1 schematically illustrates an example apparatus 1 which may be used in implementations of the disclosure. The apparatus 1 illustrated in FIG. 1 may be a chip or a chip-set. In some examples the apparatus 1 may be provided within a user device such as a mobile phone which may be associated with the user. In some examples an apparatus 1 may be provided in a device which is attached to the object.

The example apparatus 1 comprises controlling circuitry 3. Where the apparatus 1 is provided within a user device the controlling circuitry 3 may enable control of the functions of the user device. For instance, where the user device is a mobile telephone the controlling circuitry 3 may control the user device to enable access to a cellular communications network.

The controlling circuitry 3 may comprise one or more controllers. The controlling circuitry 3 may be implemented using instructions that enable hardware functionality, for example, by using executable computer program instructions in a general-purpose or special-purpose processing circuitry 5 that may be stored on a computer readable storage medium (disk, memory etc) to be executed by such processing circuitry 5.

The processing circuitry 5 may be configured to read from and write to memory circuitry 7. The processing circuitry 5 may comprise one or more processors. The processing circuitry 5 may also comprise an output interface via which data and/or commands are output by the processing circuitry 5 and an input interface via which data and/or commands are input to the processing circuitry 5.

The memory circuitry 7 may be configured to store a computer program 9 comprising computer program instructions (computer program code 11) that controls the operation of the apparatus 1 when loaded into processing circuitry 5. The computer program instructions, of the computer program 9, provide the logic and routines that enables the apparatus 1 to perform the example methods illustrated in FIG. 4. The processing circuitry 5 by reading the memory circuitry 7 is able to load and execute the computer program 9.

In the example apparatus 1 of FIG. 1 information 13 may be stored in the memory circuitry 7. The information 13 may be retrieved from the memory circuitry 7 and used by the processing circuitry 5 in some of the examples of the disclosure. The information 13 may comprise three dimensional model information. The three dimensional model information may relate to a location of the user and may be used to enable the processing circuitry 5 to determine the field of view of a user.

The apparatus 1 therefore comprises: processing circuitry 5; and memory circuitry 7 including computer program code 11; the memory circuitry 7 and the computer program code 11 configured to, with the processing circuitry 5, cause the apparatus 1 at least to perform: obtaining information relating to a position of an object relative to a user 27; determining a field of vision of the user 27; determining whether or not the object is in the field of vision of the user 27; and if it is determined that the object is not in the field of vision of the user 27 enabling an alert to be provided.

The computer program 9 may arrive at the apparatus 1 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), an article of manufacture that tangibly embodies the computer program. The delivery mechanism may be a signal configured to reliably transfer the computer program 9. The apparatus may propagate or transmit the computer program 9 as a computer data signal.

Although the memory circuitry 7 is illustrated as a single component in the figures it is to be appreciated that it may be implemented as one or more separate components some or all of which may be integrated/removable and/or may provide permanent/semi-permanent/dynamic/cached storage.

Although the processing circuitry 5 is illustrated as a single component in the figures it is to be appreciated that it may be implemented as one or more separate components some or all of which may be integrated/removable.

References to "computer-readable storage medium", "computer program product", "tangibly embodied computer program" etc. or a "controller", "computer", "processor" etc. should be understood to encompass not only computers having different architectures such as single/multi-processor architectures and sequential (Von Neumann)/parallel architectures but also specialized circuits such as field-programmable gate arrays (FPGA), application specific integrated circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

Figure 2:
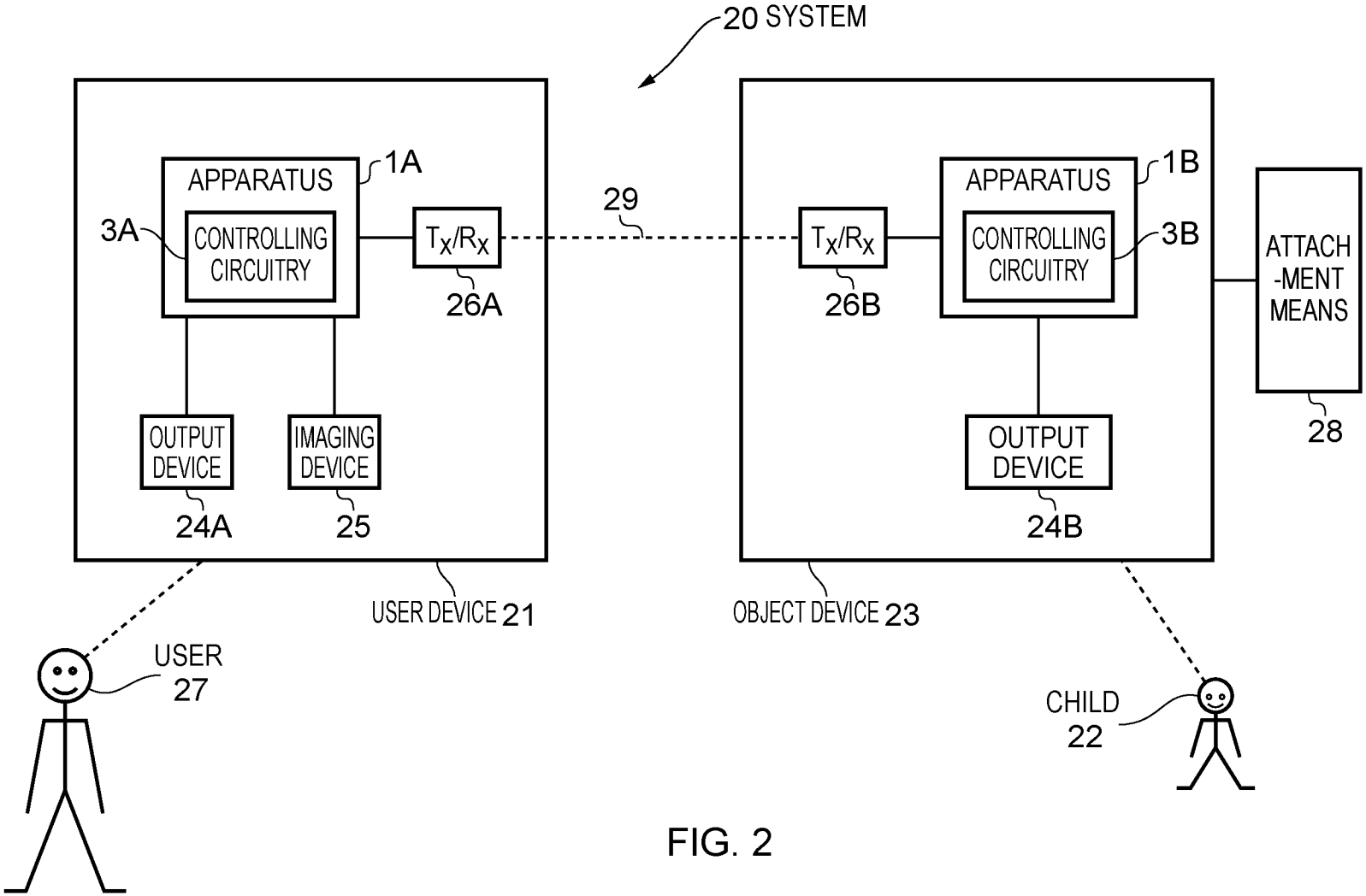
FIG. 2 illustrates a system.

FIG. 2 schematically illustrates a system 20 according to examples of the disclosure. In the example of FIG. 2 the system 20 comprises a user device 21 and an object device 23. The system 20 may enable a user 27 associated with the user device 21 to ensure that an object associated with the object devices remains in the field of the vision of the user 27.

The user device 21 may comprise any device which may be associated with the user 27. The user device 21 may be carried by the user 27 so that the position of the user device 21 corresponds to the position of the user 27.

In the example system 20 of FIG. 2 the user device 21 comprises an apparatus 1A, a transceiver 26A, an output device 24A and an imaging device 25. It is to be appreciated that only features necessary for the following description have been illustrated in FIG. 2 and that other examples may comprise additional features.

The user device 21 may comprise a portable user device. For example, the user device 21 may be a device such as a mobile telephone, a tablet computer, a wearable electronic device or any other suitable device. The user device 21 may be a portable electronic user device 21 which can be carried in a user's 27 hand or bag. The user device 21 may be a hand held device such that it is sized and shaped so that the user can hold the user 27 device 21 in their hand while they are using the user device 21.

The apparatus 1A of the user device 21 may be as illustrated in FIG. 1 and may comprise controlling circuitry 3A as described above. Corresponding reference numerals are used for corresponding features.

The output device 24A may comprise any means which may be configured to provide an alert or other information to the user 27.

In some examples the output device 24A may comprise a display. The display may comprise any means which may enable information to be displayed to the user 27. The display may comprise any suitable display such as a liquid crystal display, light emitting diode, organic light emitting diode, thin film transistor or any other suitable type of display. In some examples the display may comprise a near eye display which may be configured to be positioned in proximity to the eye of the user. The display may be configured to provide a visual alert to the user 27. The visual alert could comprise a notification that an object is out of the field of vision or is about to move out of the field of vision.

In some examples the output device 24A may comprise an audio output device such as a loudspeaker which may be configured to provide an audio output signal. The audio output device may be configured to provide audible alerts to the user 27.

In some examples the output device 24A may comprise a haptic feedback device which may be configured to provide an alert which may be felt by the user 27. For instance the output device 24A may comprise a vibration mechanism which may be configured to vibrate the device to provide an alert to the user.

It is to be appreciated that any other methods and means of providing an alert to the user 27 may be used in other examples of the disclosure.

The transceiver 26A may comprise one or more transmitters and/or receivers. The transceiver 26A may comprise any means which enables the user device 21 to establish a communication connection 29 with a remote device, and exchange information with the remote device. The remote device may be an object device 23 such as the object device illustrated in FIG. 2. In some examples the remote device could be another user device or a server or any other suitable device.

The communication connection 29 may comprise a wireless connection. The wireless communication connection 29 may be a secure wireless communication connection 29. In some examples the wireless communication connection 29 may comprise a connection such as Bluetooth, wireless local area network (wireless LAN), high accuracy indoor positioning (HAIP) network connection or any other suitable connection.

The example user device 21 of FIG. 2 also comprises an imaging device 25. The imaging device 25 may comprise any means which enables the user device 21 to obtain images. The images which are obtained may provide a representation of a scene and/or items and objects which are positioned in front of the imaging device 25. In some examples the images which are obtained may be used to enable a field of vision of the user 27 to be determined. In some examples the images which are captured may be transmitted to another user device to enable another user to use the images to monitor the location of an object.

In the example of FIG. 2 only one imaging device 25 is illustrated. In some examples the user device 21 may comprise more than one imaging device 25. For example the user device 21 may comprise a front face camera, a rear face camera, a dual camera that captures 3D images or any combination of such imaging device 25.

The object device 23 may comprise any device which may be associated with an object. The object device 23 may be associated with the object such that the position of the object corresponds to the position of the object device 23. In the example system of FIG. 2 the object is a child 22. In such examples the user associated with the user device 21 may be a parent or guardian of the child 22.

In the example system 20 of FIG. 2 the object device 23 comprises an apparatus 1B, a transceiver 26B, an output device 24B and an attachment device 28. It is to be appreciated that only features necessary for the following description have been illustrated in FIG. 2 and that other examples may comprise additional features.

The apparatus 1A of the user device 21 may be as illustrated in FIG. 1 and may comprise controlling circuitry 3A as described above. Corresponding reference numerals are used for corresponding features.

The output device 24B may comprise any means which may be configured to provide an alert or other information to the object. In some examples the output device 24B may comprise at least one of a display, an audio output device or a haptic feedback device or any other suitable device. The output device 24B of the object device 23 may be similar or the same as the output device 24A of the user device 21.

The transceiver 26B of the object device 23 may be similar or the same as the transceiver 26A of the user device 21. The transceiver 26B may comprise one or more transmitters and/or receivers which may enables the object device 23 to establish the communication connection 29 with a remote device, and exchange information with the remote device. In the example of FIG. 2 the remote device is a user device 21. In some examples the remote device could be another object device or a server or any other suitable device.

The example object device 23 of FIG. 2 also comprises attachment means 28. The attachment means may comprise any means which enables the object device to be secured to the object so that the position of the object device 23 corresponds to the position of the object.

In the example system 20 of FIG. 2 the object associated with the object device 23 is a child 22. In such examples the attachment means 28 may comprise any means which may enable the object device 23 to be secured to the child's body or clothing. In some examples the attachment means 28 may comprise a strap which may be attached around a part of the body of the child 22 such as the child's arm, leg or chest. In other examples the attachment means 28 may comprise an adhesive portion which may enable the object device 23 to be adhered to the child's skin or clothing. In some examples the attachment means may comprise a clip or pin which may enable the object device 23 to be attached to the child's clothing.

In other examples the object associated with the object device 23 could be an inanimate object such as luggage or a bike or any other suitable object. In such examples the attachment means 28 may enable the object device to be secured to the inanimate object. In some examples the inanimate object could be a communication device such as a mobile phone or tablet. In such examples the object device 23 need not have the attachment means 28 as the controlling circuitry 3 of the phone or tablet could be configured to implement the methods of the disclosure.

Figure 3:
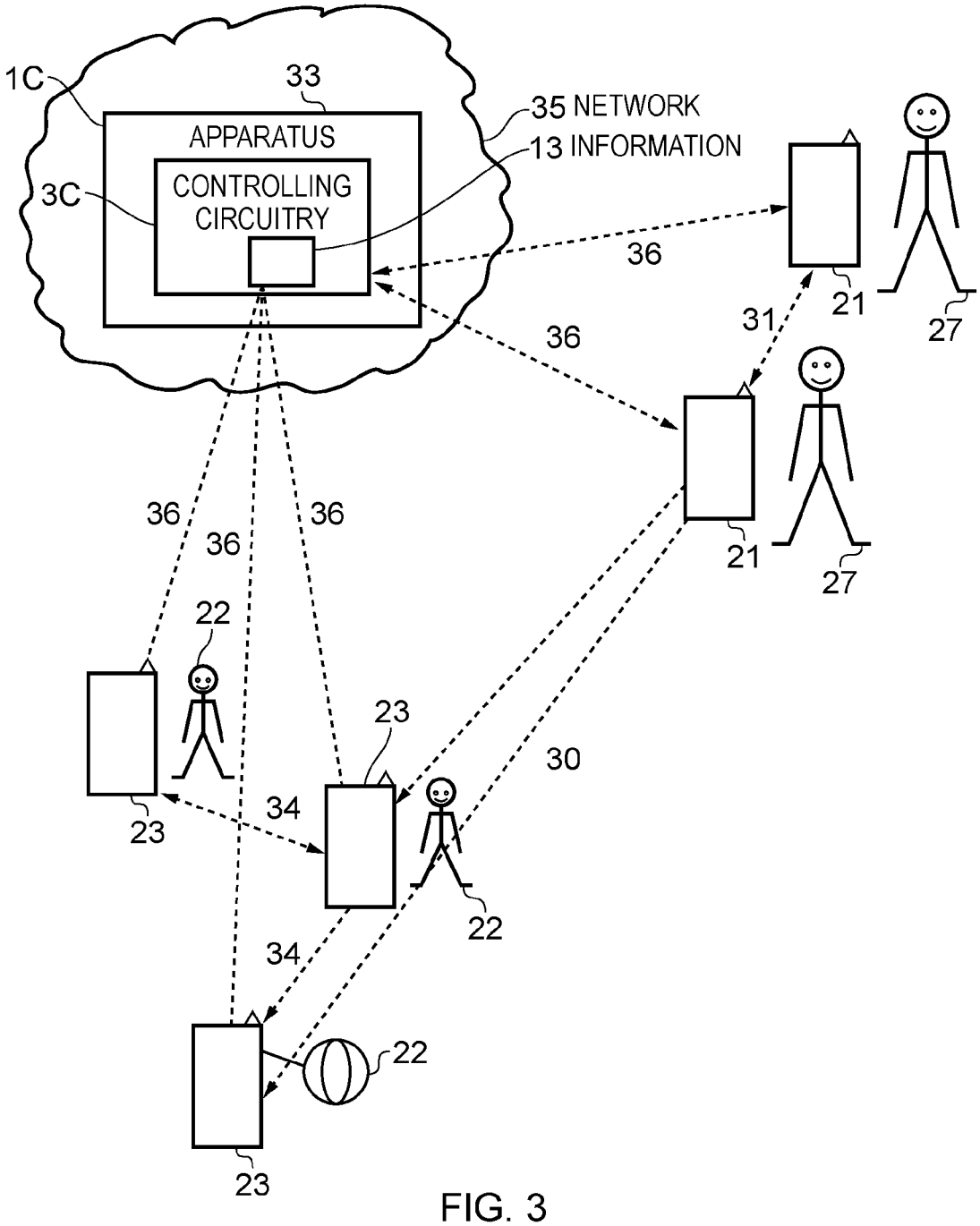
FIG. 3 illustrates another system.

FIG. 3 illustrates another system 30 which may be used in some examples of the disclosure. The example system 30 of FIG. 3 comprises a plurality of user devices 21 and a plurality of object devices 23. In the particular example of FIG. 3 two user devices 21 and three object devices 23 are illustrated. The two user devices 21 are associated with two different users 27 and the three object devices 23 are associated with three different objects. It is to be appreciated that any number of devices may be provided in other implementations of the disclosure. In some examples the system 30 may also comprise a server 33.

The user devices 21 may be as described above. The user devices 21 may each be associated with different users 27. In some examples the user devices 21 may be configured to enable information to be exchanged between the user devices 21. In some examples a communication connection 31 between the user devices 21 may be used to exchange the information. The communication connection 31 may be a local area network connection such as Bluetooth, wireless local area network (wireless LAN) or any other suitable connection. In other examples the user devices 21 may be configured to exchange information via the server 33.

The object devices 23 may also be as described above. In the example of FIG. 3 three object devices 23 are provided. Two of the object devices are associated with children 22. The object devices 23 may be attached to the children or the clothing of the children.

Another object device 23 is associated with an inanimate object. The inanimate object could be a toy that one or more of the children 22 are playing with. In the example of FIG. 3 the inanimate object is a ball. In other examples other objects may be included in the system 30.

In some examples communication connections 34 may be provided between pairs of the object devices 23. The communication connections 34 may be local area network connections such as Bluetooth, wireless local area network (wireless LAN) or any other suitable connection. In some examples the communication connections 34 may be provided between objects which are associated with each other. For instance communication connections may be established between object devices 23 of children who are playing with each other or between object devices 23 of a child and a toy the child is playing with.

The server 33 may be located remotely to the user devices 21 and object devices 23. The server 33 may comprise an apparatus 10. The apparatus 1C may comprise controlling circuitry 30 which may be as described above in relation to FIG. 1. The server 33 may be provided within a communication network 35. The communication network 35 may be a wireless communication network such as cellular network, a WiFi network, a Bluetooth network or any other suitable network.

The server 33 may be configured to establish communication connections 36 with the devices in the system 30. In some examples the server 33 may be configured to establish communication connections 36 between one or more of the user devices 21 and/or one or more of the object devices 23. This may enable information to be exchanged between the respective devices in the system 30.

In some examples server 33 may be configured to store information 13. The information 13 may be stored in memory circuitry 7 which may be part of the controlling circuitry 3C. The information 13 may comprise three dimensional modelling information. The three dimensional modelling information may enable the field of vision of user 27 to be determined. The three dimensional modelling information may be used to determine if there are items between a user 27 and an object which block the field of vision of the user 27. In some examples the server 33 may be configured to provide three dimensional modelling information to some of the devices within the system 30.

Figure 4:
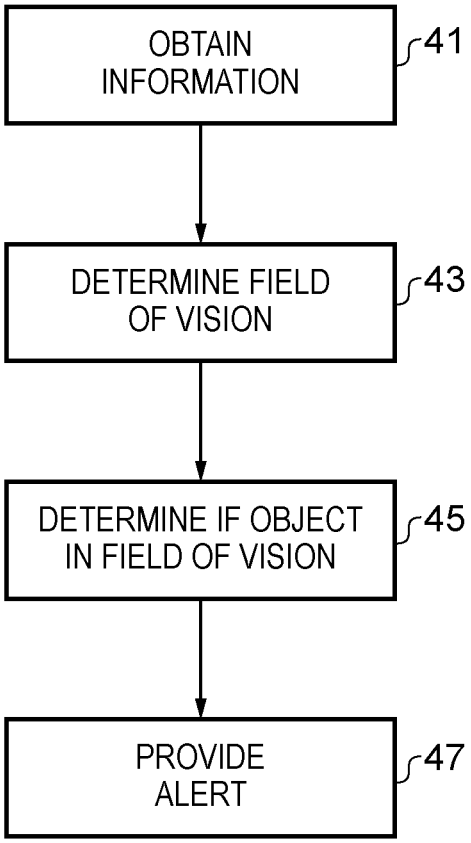
FIG. 4 illustrates a method.

FIG. 4 illustrates a method according to examples of the disclosure. The method may be implemented using apparatus 1 and/or user devices 21 and object devices 23 as described above.

The method comprises, at block 41, obtaining information 13 relating to a position of an object relative to a user 27. At block 43 a field of vision of the user 27 is determined. The field of vision may be the field of vision of a user device 21 which may be associated with the user 27. At block 45 it is determined whether or not the object is in the field of vision of the user 27. If it is determined that the object is not in the field of vision of the user 27 then, at block 47, the method comprises enabling an alert to be provided.

In some examples the method may also comprise monitoring a trajectory of the object relative to the user. In such examples if it is determined that the object is predicted to go out of the field of vision of the user the method may also comprise enabling a warning alert to be provided.

In some examples the method of FIG. 4 may be performed by an apparatus 1 within a user device 21. In other examples the method may be performed by an apparatus 1 within an object device 23. In some examples the method may be distributed between more than one apparatus so that some parts of the method may be performed by an object device 23 and some may be performed by a user device 21. In some examples a server 33 may also perform some or all of the method. In some examples an apparatus 1 may cause at least part of the method to be performed. The apparatus 1 may cause some of the blocks of the method to be performed. The apparatus 1 may cause at least part of any of the blocks to be performed.

Figure 5:
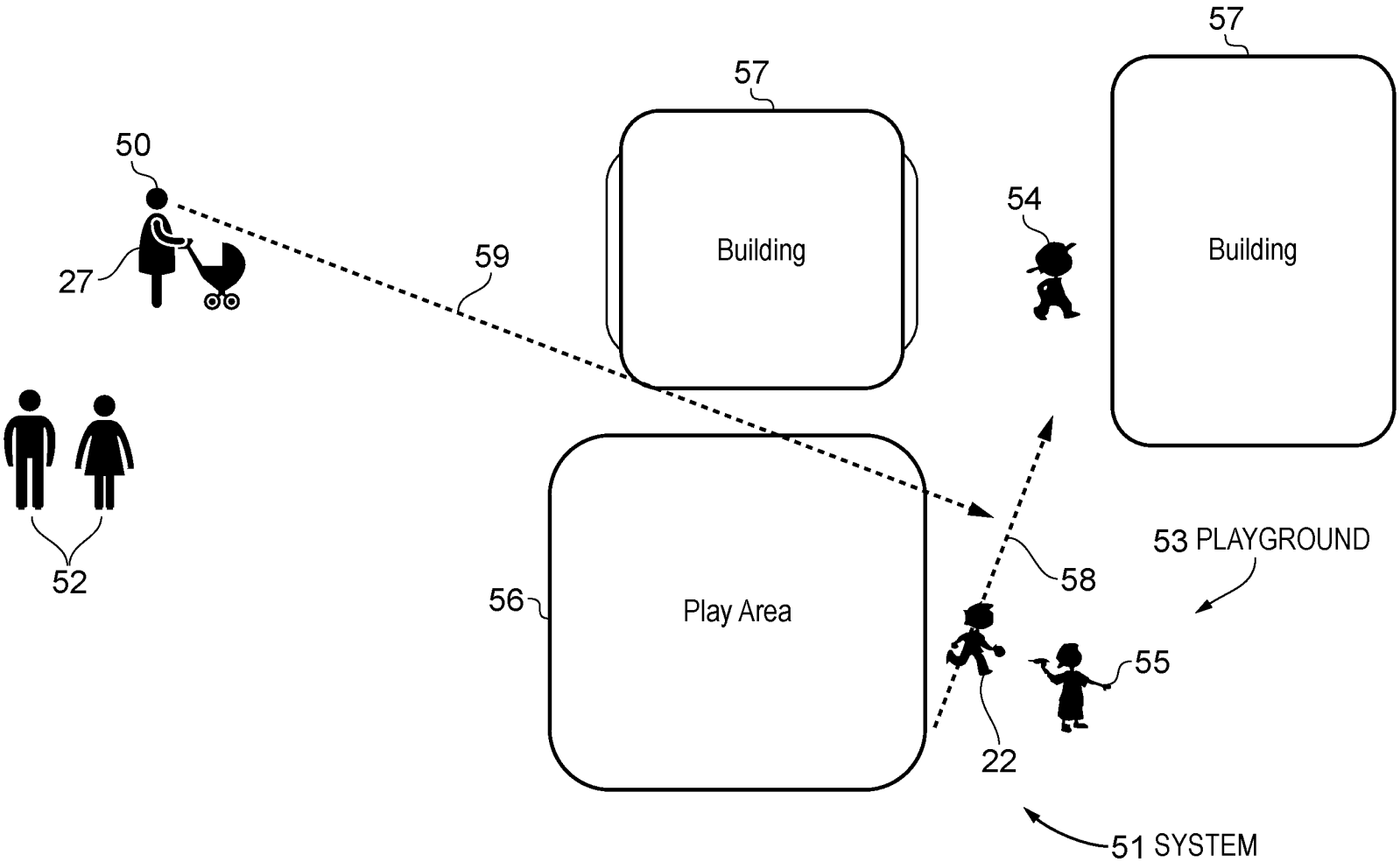
FIG. 5 illustrates an implementation of the disclosure.
Figure 6:
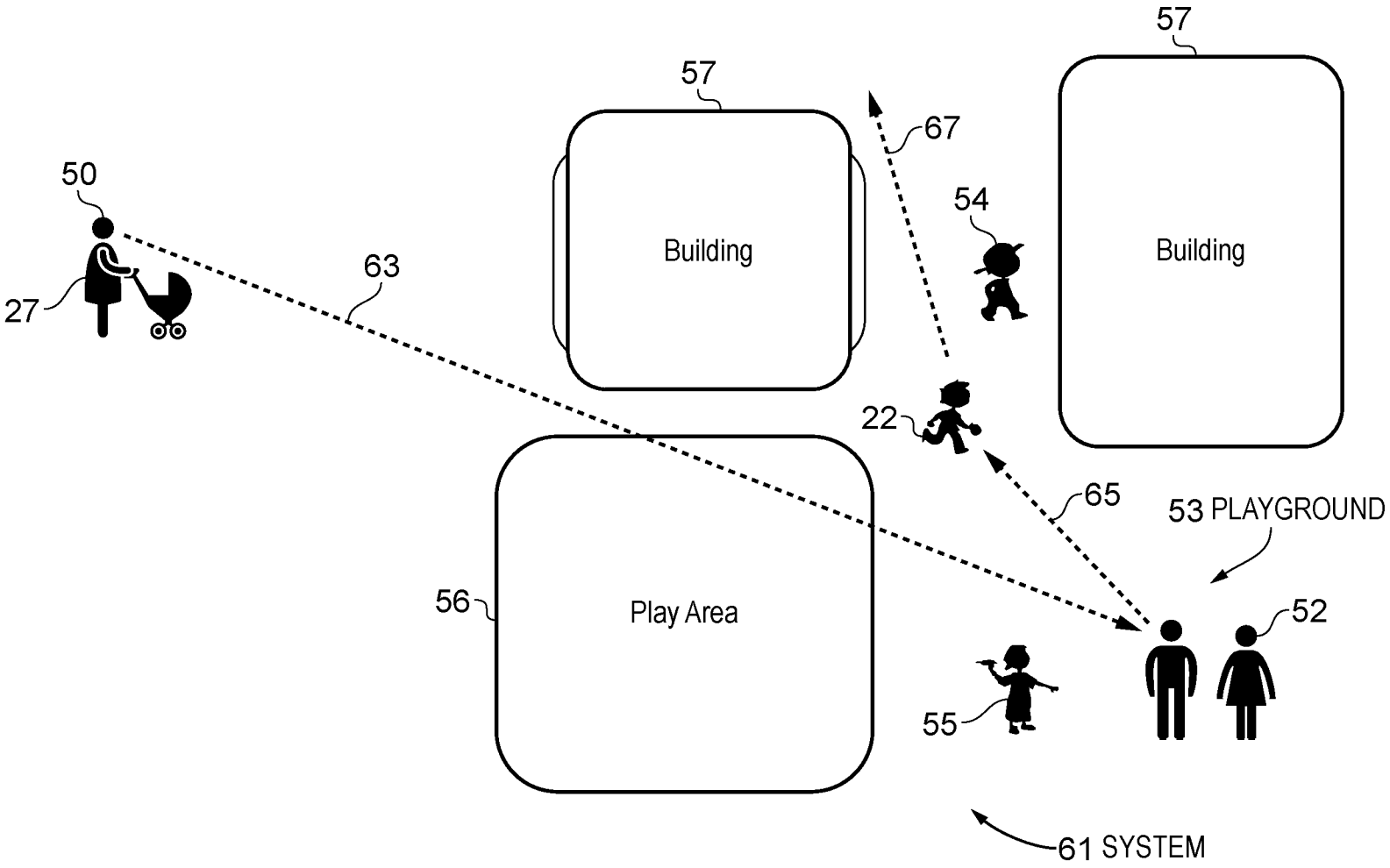
FIG. 6 illustrates another implementation of the disclosure.

FIGS. 5 and 6 illustrate example implementations of the disclosure in more detail.

FIG. 5 illustrates an example system 51 in which a parent 50 can ensure that their child 22 does not leave their field of vision. In the example of FIG. 5 the user 27 associated with the user device 21 is the parent 50 and the object associated with the object device 23 is a child 22. The system of FIG. 5 can help a parent 50, or other guardian ensure that the child 22 is safe.

In the example system 51 of FIG. 5 the parent 50 and child 22 are located in a playground 53. The parent 50 wishes to ensure that the child 22 does not move out of sight.

The parent 50 may carry a user device 21 as described above. The user device 21 could be a communication device such as mobile phone or tablet computer. In some examples the user device 21 may comprise smart glasses or a smart watch or any other wearable device.

In the example of FIG. 5 other adults 52 are currently located near to the parent 50. In some examples the other adults 52 may also be users 27 associated with user devices 21. This may enable information to be exchanged between the parent 50 and the other adults 52.

The child 22 may be associated with an object device 23. In some examples the child 22 may wear the object device 23. For example the child 22 could wear the object device 23 as a strap attached to their leg or arm. This may make it more difficult for the child 22 to remove the object device 23. In some examples the object device 23 could be attached to the clothing of the child 22 or carried in a pocket of the clothing of the child 22.

The user device 21 of the parent 50 may be associated with the object device 23 of the child 22. The object device 23 of the child 22 may be identified as the object device 23 associated with the parent's child. When the correct object device 23 has been identified a communication connection may be established between the user device 21 and the object device 23. The communication connection may enable information about the relative locations of the parent 50 and the child 22 to be exchanged between the devices 21, 23 as needed. In some examples the information may be exchanged directly between the user device 21 and the object device 23. In other examples one or more intermediate devices such as a server 33 may be provided to enable the exchange of information.

In the example of FIG. 5 there are two other children 54, 55 playing in the play ground 53. In the example of FIG. 5 the parent 50 is only monitoring the position of the child 22. The other children 54, 55 may be the children of other parents and/or the other children 54, 55 may be older and might not need such close supervision.

In the example of FIG. 5 the playground 53 comprises a play area 56. The play area 56 could comprise play equipment such as climbing frames or other items. In the example of FIG. 5 there are also buildings 57 which are located near to the play ground 53.

In some examples the methods of the disclosure may be implemented by a user device 21. In such examples the user device may obtain information about the position of the child 22 relative to the parent 50. As the child 22 is associated with the object device 23 and the parent 50 is associated with the user device 21 information about the relative position of the user device 21 and the object device 23 provides information about the relative position of the child 22 and the parent 50.

The position information could be obtained using any suitable methods and means. In some examples the position information could be obtained by using positioning beacons which may located around the playground 53 and may be configured to exchange information with the user device 21 and/or the object device 23. In some examples positioning information such as global positioning system (GPS) information may be used to determine the location of the object relative to the user. In some examples the parent 50 and child 22 could be located indoors, for example in an indoor play area or a shopping centre. In such examples a protocol such as HAIP could be used to obtain the location information. Other examples may be used in other implementations of the disclosure.

In some examples information about the location of the child 22 may be provided to the user device 21. The user device 21 can then determine the position of the child 22 relative to the parent 50. In other examples information about the position of the parent 50 may be provided to the object device 23. This may enable the object device 23 to determine the position of the child 22 relative to the parent 50. In some examples information relating to the position of the parent 50 and the position of the child 22 may be provided to a server 33 so that the server 33 can determine the position of the child 22 relative to the parent 50.

The field of vision of the parent 50 may be determined. The field of vision may comprise all points within an area that a user 27 is able to view. The field of vision may take into account the distance the user 27 can see, the width of vision that the user 27 can see and any items that may be blocking the field of vision. The field of vision may be determined based upon the current location of the user 27

Three dimensional mapping information may be used to determine items which may obstruct the user's field of vision. The items may comprise one or more structures and/or buildings 57 or geographical features or shapes in the terrain or any other suitable feature. The three dimensional mapping information may comprise information 13 relating to items which may be positioned in the area around the user 27 and the object. The three dimensional mapping information may comprise information relating to the locations and relative heights and shapes of the items in the area. The items in the area could comprise any items which may obstruct the field of vision of the user 27. In the example of FIG. 5 the items which could block the parents 50 field of vision could comprise playground equipment such as climbing frames. In other examples the items could comprise natural or geographic items such as hills or mounds or trees or bushes. In some examples the items could comprise buildings 57 or parts of buildings.

In some examples the user device 21 may be configured to determine the field of vision of the user 27. In other examples any device within a system 51 could be used to determine a user's field of vision. For instance a server 33 could determine the fields of vision for a plurality of users 27.

In some examples the field of vision may also take into account the context of the user 27. For example it may take into account the direction that the user 27 is looking in, the height of the user 27, whether the user 27 is sitting or standing, whether the user is stationary or moving, a direction that the user 27 is moving or any other suitable factors.

The system 51 may be configured to determine if the child 22 is in the field of vision of the parent 50. In some examples determining if a child 22 is in the field of vision of the parent 50 may comprise determining whether or not an item is blocking the view between the parent 50 and the child 22. The three dimensional modelling information may be used to determine if any items are blocking the field of vision.

In the example of FIG. 5 it is determined that the child 22 is still in the field of vision of the parent 50. The play area 56 may be sized and shaped so that the parent 50 can see over the play area 56 and see the child 22 on the other side. In such circumstances it may be determined that the child 22 is still in the field of vision and so no alert is provided. However, monitoring of the relative positions of the user 27 and the object may continue in case relative position of the parent 50 and child 22 changes.

If it had been determined that the child 22 was no longer in the field of vision of the parent 50 then an alert would have been provided. In some examples the alert could be provided to the user 27. The alert could be any notification which informs the parent 50 that the child 22 is no longer in their field of vision. The alert could be visual, tactile or audible or any other type of alert. The alert may be provided by the output device 24A of the user device 21.

In some examples the alert could be provided to the object device 23 instead of or in addition to an alert provided to the user 27. In some examples the alert could provide an audio alert, a visual alert a tactile alert or any other suitable alert which could be provided by the output device 24B of the object device 23. The alert could provide a message to the child 22. For instance it could inform the child 22 to stop where they are or to return to their previous position.

In some examples if it is determined that the child 22 is no longer in the field of vision location the information relating to the current position of the child 22 could be provided to the user device 21. This information could then be used to enable the parent 50 to find the child 22. For instance, if it started to rain then a child 22 might run to the nearest shelter. The nearest shelter could be near the parent 50 but could be out of sight. In such examples the parent 50 can obtain the information relating to the location of the child 22 and know that the child 22 is safe before they can actually see the child 22.

In some examples the system 51 may enable a trajectory of an object 22 relative to the user 27 to be monitored. A predicted trajectory of the object 22 may be obtained. The predicted trajectory may be used to predict whether or the not the object 22 will remain in the field of vision of the user. The predicted trajectory may take into account movement of the object 22 and/or movement of the user 27.

The predicted trajectory may be obtained using any suitable methods. In some examples the predicted trajectory may be obtained by monitoring the current movement of the object 22 and extrapolating that forward.

In other examples the predicted trajectory of an object 22 may be obtained by comparing the trajectory of the object 22 with the trajectory of other objects. For instance, in the example of FIG. 5 the child 22 is playing with other children 54, 55. An association between the object device 23 of the child 22 and the object devices 23 of the other children 54, 53 could be established. If one or more of the other children 54, 53 moves in a particular direction it may be likely that the child 22 would follow them. Similarly if the child 22 is playing with an object such as a ball the trajectory of the ball could be monitored. If the ball moves in a particular direction then it could be predicted that the child 22 would follow the ball in that direction.

If it is determined that the object 22 is predicted to go out of the field of vision of the user then a warning alert may be provided. As mentioned above the warning alert could be provided to the parent 50 and/or to the child 22.

In the example of FIG. 5 one of the other children 54 has moved to a position between the buildings 57. This may be a safe position for this other child 54 as the other child 54 may still be in the field of vision of their own parents or the other child 54 could be old enough to be allowed out of sight of their parents. An association between the child 22 and the other child 54 may have been established. For instance, the children 22, 54 could have been playing together or may be related or otherwise known to each other.

The predicted trajectory of the child is given by the dashed lined 58 indicated in FIG. 5. The predicted trajectory 58 may be calculated by assuming that the child 22 will move towards the current location of the other child 54. Other methods for predicting a trajectory 58 may be used in other examples of the disclosure.

In FIG. 5 the child 22 is currently in the field of vision of the parent 50 as is indicated by the dashed line 59. However, if the child 22 follows the predicted trajectory 58 the child will move out of the field of vision. This may cause a warning alert to be provided to the parent 50 and/or child 22 to prevent the child 22 from moving out of the field of vision of the parent 50.

FIG. 6 illustrates another example system 61 in which a parent 50 can ensure that their child 22 does not leave their field of vision. In the example of FIG. 6 the user 27 associated with the user device 21 is the parent 50 and the object associated with the object device 23 is a child 22. In the system 61 of FIG. 6 the other adults 52 have user devices 21 associated with them. The parent 50 can use information obtained from the user devices 21 associated with the other adults 52 to ensure that the child 22 remains in view of at least one of the adults. The system of FIG. 6 allows a parent 50 to use information obtained from other user devices 21, to ensure that the child 22 is safe.

In the example system 61 of FIG. 6 the parent 50 and child 22 are located in a playground 53 which may be as described above in relation to FIG. 5. Corresponding reference numerals are used for corresponding features. As in the example of FIG. 5 the child 22 is associated with an object device 23. Two other children 54, 55 in addition to the child 22 are playing in the playground 53.

In the example of FIG. 6 the other adults 52 are currently located near to the child 22 and the other children 54, 55. One or more of the other adults 52 may also be users 27 associated with user devices 21. The user devices 21 associated with the other adults 52 may comprise any suitable user device 21 such as communication devices or a wearable electronic device.

In some examples the user devices 21 associated with the other adults 52 may comprise a camera or other imaging device 25. For example the user device 21 could comprise smart glasses or other wearable camera device. In such examples the user devices 21 associated with the other adults 52 could be configured to transmit the obtained image information to the user device 21 of the parent 50 or any other devices.

In the example of FIG. 6 the parent 50 may request to obtain information from the user devices 21 of the other adults 52. The information which is requested from the user devices 21 of the other adults 52 may comprise any information which enables the parent to ensure the position and/or safety of their child 22.

In some examples the information which is requested could be image information from the user device 21. For instance, if the user device 21 of the other adults 52 comprises smart glasses or a wearable camera then the image information obtained by the imaging device could be provided to the parent 50. This could enable the parent 50 to watch their child even when the child 22 is not in their field of vision. In such examples of the disclosure the field of vision of the parent 50 is extended to comprise all points within an area that a user 27 is able to view as well as areas that can imaged by the user device 21 of the other adults 52. This enables the parent 50 to monitor their child 22 over a larger area.

In some examples the information which is requested could be conformation that the other adult 52 can view the child 22. In such examples it may be determined whether or not the child 22 is in a field of vision of the other adults 52. In such cases the user device 21 of the parent 50 could query the user devices 21 of the other adults 52. The user devices of the other adults 52 could respond with an indication of whether or not the child 22 is still in their field of vision. If the child 22 is not in the other adults field of vision or is predicted to be moving out of the other adults field of vision then an alert may be provided. The alert could be provided to the parent 50 and/or the child 22 and/or the other adults 52. This may enable the effective field of vision of the parent 50 to be extended to include the field of vision of other adults 52 in the area.

In such examples the other adults 52 could be trusted adults. They may be known to the parent 50 or may be users 27 that the parent 50 has shared information with before. The user devices 21 could be paired to enable the information to be exchanged. In some examples it may be determined that the parent 50 has a connection with the other adults 52, for example they may be connected via social networking or identifications corresponding to the other adults may be stored on the user device 21 of the parent 50.

In some examples the pairing between user devices 27 could happen automatically. For instance if it is detected that the parent 50 is near another user device 21 with which they have previously paired then the respective user devices 21 may be configured to exchange information.

In other examples the pairing of the user devices 21 may require confirmation from the users 27. For instance if the parent 50 goes to the playground 53 and sees other adults 52 there they could make a request to the other adults 52 that the user devices 21 can be paired to enable surveillance of the children in the playground 53. In some examples a parent 50 could initiate a request by pointing their user devices 21 in the direction of the other adults 52.

In the example of FIG. 6 the field of vision of the parent 50 is indicated by the dashed line 63. In the example of FIG. 6 it is determined that the child 22 is not in the field of vision of the parent 50. In response to this determination it is identified whether or not the child 22 is in the field of vision of other adults 52 around the playground 53.

In the example of FIG. 6 the field of vision of the other adults 52 is indicated by the dashed line 65. In the particular example of FIG. 6 the other adults 52 are located on the same side of the play area 56 as the child 22. In this case it is determined that the child 22 is still in the field of vision of the other adults 52. This information may be provided to the user device 21 of the parent 50 so that parent 50 knows that the child 22 is still safe even though they cannot currently see the child 22.

In the example of FIG. 6 when it is determined that the child 22 is not in the field of vision of the parent 50 an alert may be provided. The parent 50 may request information from the user devices 21 of the other adults 52 in response to the alert. In other examples the information from the user devices 21 of the other adults 52 may be requested automatically when it is determined that the child 22 is not in the field of vision of the parent 50. In such cases an alert could be provided if it is determined that neither the parent 50 nor the other adults 52 can see the child 22.

In the example of FIG. 6 the expected trajectory of the child 22 is indicated by the dashed line 67. This trajectory extends between the buildings 57 and out of the field of vision of the parent 50. However, this trajectory is still in the field of vision of the other adults 52 and so the parent 50 can know that their child 22 is safe even when they cannot currently see the child 22.

In the example of FIG. 6 the parent obtains information from other adults 52. It is to be appreciated that the other users 27 need not be adults. For example the other users could be another sibling or a friend of the child 22.

In some examples the information from the user devices 21 of the other adults 52 may be provided in response to a query from the user device 21 of the parent 50. For instance, the user device 21 of the parent may only need to request the information if the parent 50 cannot currently see the child 22. In other examples the information from the user devices 21 of the other adults 52 may be provided at regular intervals without any specific query. This may provide reassurance to the parent 50 that the other adults 52 are still helping to monitor their child 22.

In the example of FIG. 6 only one set of other adults 52 are illustrated. It is to be appreciated that in other examples any number of other adults 52 may be positioned within the system 61.

In the examples described above the parent 50 and child 22 are at playground 55. It is to be appreciated that examples of the disclosure could be used in any other suitable location. For instance if a parent 50 is walking with a child 22 the child 22 may be permitted to walk ahead of the parent 50 but might not be allowed to walk around the corner. In such examples it may be determined when the trajectory of a parent 50 and child 22 is approaching a corner, or other item that could block the field of vision of the parent 50. An alert could then be provided to the parent 50 and/or child 22 that they are approaching a corner or other item.

In the examples described in FIGS. 5 and 6 the items which could block the view of the parent 50 are permanent items such as play areas 56 and buildings 57. In some examples items may be located in temporary positions which could temporarily block a user's field of vision. For instance a vehicle may be parked which may block a user's field of vision. In some examples information about the location of temporary objects such as vehicles may be provided to a server 33 or other suitable device. This information can then be used to update the three dimensional model information to ensure that the user's field of vision is determined correctly.

In some examples the temporary items may be configured not to obstruct the user's field of view. For instance autonomous vehicles could be configured not to park in certain areas such as near playgrounds or schools where they could obstruct a parent's view of their child. In other examples if it is determined that a temporary item such as an autonomous vehicle is blocking a users 27 field of vision then the vehicle could be controlled to move out of the field of vision.

In some examples the tracking of the objects 22 may only be needed in certain contexts. For instance if a parent 50 is at a playground or shopping centre they may wish to keep the child 22 in view at all times. However, if the parent 50 and child 22 are in their own home it may not be necessary for the parent 50 to keep the child 22 in view at all times. In some examples the parent 50 may be able to switch the surveillance on or off as needed. For example the user device 21 may comprise a user input device which may enable the user to switch the monitoring on and off. In other examples the user device 21 and/or object device 23 may be configured to determine a context of the user and/the the child. The context could be the location of the parent 50 and child 22 or any other suitable information. If it is determined that the parent 50 and child 22 are in a location such as a playground 53 then the monitoring could be switched on automatically without any direct user input. Similarly if it is determined that the parent 50 and child 22 are in a safe location, such as their own home the monitoring could be switched off automatically.

In some examples the systems 51, 61 may be configured to determine a location for a user 27 in which the object will be within their field of vision. For instance if a child 22 moves out of the field of vision of the parent 50 the location of the child 22 may be provided to the user device 21 of the parent 50. The user device 21 may then use three dimensional model information to determine a new location for the parent 50 to stand or sit in which the child 22 will be in their field vision. In some examples the information about the new location to sit or stand could be provided with the alert that is provided when it is determined that the child 22 is not in the field of vision of the parent 50 anymore.

In some examples the systems 51, 61 may be configured to recommend places for a user 27 to sit or stand in order to keep the object in their field of vision. For instance if a parent 50 arrives at a playground 53, or other area, the system 51, 61 may use three dimensional modelling information of the area to determine the optimum position for the parent 50 to sit or stand to keep the child 22 in their field of vision. In some examples a plurality of positions may be recommended to the parent 50. This may be useful if another parent is already located in the optimum position.

In the above described examples the object which is monitored is a child. It is to be appreciated that examples of the disclosure may be used in any circumstances where a user wants to take care of an object. In some examples the object could be an inanimate object such as a mobile phone, tablet computer, bike, car, luggage, clothing item or any other suitable object.

This may enable a user to ensure that objects do not get forgotten or stolen.

In some examples the inanimate object could comprise a user's luggage. The examples of the disclosure may be useful in areas such as airports or other transport hubs. The examples of the system could ensure that the user's luggage is not left unattended by the user. This could provide security to the owner of the luggage who is prevented from losing for forgetting their luggage. It can also provide confirmation to the airport check in staff that the luggage has not been left unattended.

In some examples the disclosure could be used to prevent a user 27 from forgetting their possessions. For instance a child may need to be reminded to bring their school bag home from school. Examples of the disclosure could be used to create a pairing between a user device 21 associated with a child and their school bag and provide an alert to the child if the school bag is not in the field of vision. The user device 21 could request information from the user device 21 of another trusted user 27, such as a teacher, to determine the location of their school bag.

The blocks illustrated in the FIG. 4 may represent steps in a method and/or sections of code in the computer program 9. The illustration of a particular order to the blocks does not necessarily imply that there is a required or preferred order for the blocks and the order and arrangement of the block may be varied. Furthermore, it may be possible for some blocks to be omitted.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one . . . " or by using "consisting".

In this detailed description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. An apparatus comprising at least one processor and at least one memory including computer program code, the at least one memory and the computer program code configured to, with the at least one processor, cause the apparatus to at least perform:

obtain information relating to a position of an object relative to a user;

determine a field of vision of the user, wherein determination of the field of vision of the user comprises using three dimensional model information stored in memory circuitry and relating to a location, height and shape of one or more items to determine whether the one or more items will obstruct the field of vision of the user;

determine whether or not the object is in the field of vision of the user; and based on the determination that the object is not in the field of vision of the user, enable a visual, audio or haptic alert to be provided.

2. The apparatus of claim 1, further comprising causing the apparatus to monitor a trajectory of the object relative to the user and provide a warning alert if it is determined that the object is predicted to go out of the field of vision of the user.

3. The apparatus of claim 2, further comprising causing the apparatus to associate the object with a further object and predict movement of the object based on the movement of the further object.

4. The apparatus of claim 1, wherein determination of the field of vision of the user comprises determination of at least one of: a direction the user is looking, a direction the user is travelling, a location of a user, or items positioned between the user and the object.

5. The apparatus of claim 1, wherein the alert is provided to the user and/or the object.

6. The apparatus of claim 1, further comprising causing the apparatus to enable communication between a plurality of user devices and determine the field of vision of the plurality of users associated with the devices and enable an alert to be provided if the object moves out of the field of vision of the plurality of users.

7. The apparatus of claim 1, further comprising providing information regarding a temporary object in order to update the three dimensional model information, wherein the temporary object is temporarily located at a respective position.

8. A method comprising:

obtaining information relating to a position of an object relative to a user;

determining, with at least one processor, a field of vision of the user, wherein determining the field of vision of the user comprises using three dimensional model information stored in memory circuitry and relating to a location, height and shape of one or more items to determine whether the one or more items will obstruct the field of vision of the user;

determining whether or not the object is in the field of vision of the user; and based on the determination that the object is not in the field of vision of the user enabling a visual, audio or haptic alert to be provided.

9. The method of claim 8, further comprising monitoring a trajectory of the object relative to the user and provide a warning alert if it is determined that the object is predicted to go out of the field of vision of the user.

10. The method of claim 9, further comprising associating the object with a further object and predicting movement of the object based on the movement of the further object.

11. The method of claim 8, wherein determining the field of vision of the user comprises determining at least one of: a direction the user is looking, a direction the user is travelling, or a location of a user.

12. The method of claim 8, wherein the alert is provided to the user and/or the object.

13. The method of claim 8, further comprising enabling communication between a plurality of user devices and determining the field of vision of the plurality of users associated with the devices and enabling an alert to be provided if the object moves out of the field of vision of the plurality of users.

14. The method of claim 8, further comprising providing information regarding a temporary object in order to update the three dimensional model information, wherein the temporary object is temporarily located at a respective position.

15. A computer program product comprising at least one non-transitory computer-readable storage medium having computer-executable program code instructions stored therein, the computer-executable program code instructions comprising:

program code instructions for obtaining information relating to a position of an object relative to a user;

program code instructions for determining a field of vision of the user, wherein determination of the field of vision of the user comprises using three dimensional model information stored in memory circuitry and relating to a location, height and shape of one or more items to determine whether the one or more items will obstruct the field of vision of the user;

program code instructions for determining whether or not said object is in the field of vision of said user; and program code instructions for enabling, based on a determination that said object is not in the field of vision of said user, a visual, audio or haptic alert to be provided.

16. The computer program product of claim 15, further comprising program code instructions for monitoring a trajectory of the object relative to the user and provide a warning alert if it is determined that the object is predicted to go out of the field of vision of the user.

17. The computer program product of claim 16, further comprising program code instructions for associating the object with a further object and predicting movement of the object based on the movement of the further object.

18. The computer program product of claim 15, wherein determining the field of vision of the user comprises determining at least one of: a direction the user is looking, a direction the user is travelling, or a location of a user.

19. The computer program product of claim 15, wherein the alert is provided to the user and/or the object.

20. The computer program product of claim 15, further comprising program code instructions for enabling communication between a plurality of user devices and determining the field of vision of the plurality of users associated with the devices and enabling an alert to be provided if the object moves out of the field of vision of the plurality of users.

21. The computer program product of claim 15, providing information regarding a temporary object in order to update the three dimensional model information, wherein the temporary object is temporarily located at a respective position.

* * * * *